United States Patent [19]

MacNitt, Jr. et al.

[11] 4,265,105

[45] May 5, 1981

[54] FORGING APPARATUS

[75] Inventors: Donald G. MacNitt, Jr., Singer Island; Bryant H. Walker, Stuart, both of Fla.

[73] Assignee: United Technologies Corporation, Hartford, Conn.

[21] Appl. No.: 90,184

[22] Filed: Nov. 1, 1979

[51] Int. Cl.[3] ..... B21K 1/32

[52] U.S. Cl. ..... 72/354; 29/159 R; 29/156.8 B; 72/403; 72/474

[58] Field of Search ..... 72/353, 474, 354, 481, 72/357, 403, 358, 359, 360; 29/159 R, 159.1, 159.2, 159.01

[56] References Cited

U.S. PATENT DOCUMENTS

| | | | |
|---|---|---|---|
| 1,765,807 | 6/1930 | Thomas | 72/481 X |
| 2,125,068 | 7/1938 | Dempsey | 72/358 |
| 2,689,539 | 2/1954 | Lyon | 72/481 X |
| 3,519,503 | 7/1970 | Moore et al. | 148/11.5 F |
| 4,051,708 | 10/1977 | Beane et al. | 22/354 |
| 4,063,939 | 12/1977 | Weaver et al. | 29/156.8 B |
| 4,074,559 | 2/1978 | Beane et al. | 29/159 R |
| 4,150,557 | 4/1979 | Walker et al. | 29/156.8 B |

*Primary Examiner*—Leon Gilden

*Attorney, Agent, or Firm*—Robert C. Walker

[57] ABSTRACT

The present invention provides methods and apparatus improving the dimensional accuracy of forged components. Uniformity of like component details is sought and a specific object is to provide a die package for forming closely toleranced appendages integrally with a central disk structure from which the appendages extend.

In one effective embodiment incorporating concepts of the present invention, the forging dies include a stationary die and a movable die comprising at least two separately movable elements which are mounted on a common axis with the stationary die. A plurality of arcuate die segments are adjacently placed in cylindrical array about the stationary and movable dies. The arcuate die segments form cavities of the inverse geometry of the appendages to be formed and in at least one embodiment are interlocked to prevent tilting of the segments in the die package.

The movable die elements are sequenceable to form a billet of material into a workpiece having an intermediate configuration, and subsequently into a workpiece of final configuration. In at least one embodiment, pressure pads are disposed against one of the movable dies to prevent displacement of that die by the billet material as the intermediate configuration is formed.

6 Claims, 4 Drawing Figures

FORGING APPARATUS

DESCRIPTION

1. Technical Field

This invention relates to forging methods and apparatus, and particularly to such methods and apparatus by which a billet of high strength, low ductility metal alloy is forged to a desired configuration under temporary conditions of low strength and high ductility.

The concepts were developed in the gas turbine engine field for the production of integrally bladed rotors, but have very wide applicability in any industry in which complexly configured parts of accurate dimension are desired.

2. Background Art

U.S. Pat. No. 3,519,503 to Moore et al entitled "Fabrication Method for the High Temperature Alloys," of common assignee herewith, describes a forging process developed by Pratt & Whitney Aircraft, Division of United Technologies Corporation, Hartford, Conn. and known internationally as the GATORIZING® forging process. By the disclosed process, high strength, difficult to forge alloys such as those used in the gas turbine engine industry, are deformable from a billet of stock material to a nearly finished shape of relatively complex geometry. Although, only disk-shaped components were initially forged, the attractiveness of forming integrally bladed rotor disks spurred subsequent developments.

An initial die package and process for forming such integrally bladed rotors is disclosed and illustrated in U.S. Pat. No. 4,051,708 to Beane et al entitled "Forging Method" and in the divisional case thereof U.S. Pat. No. 4,074,559 to Beane et al also entitled "Forging Method." Both patents are of common assignee herewith. In accordance with these concepts, integral appendages are forged between a plurality of adjacent dies positioned about the circumference of the disk forming dies. Yet further advances include the techniques for separating the appendage forming dies from the finished forging. Two such techniques are illustrated in U.S. Pat. Nos. 4,040,161 to Kelch entitled "Apparatus and Method for Removing a Plurality of Blade Dies " and 4,150,557 to Walker et al entitled "Forging Apparatus Having Means for Radially Moving Blade Die Segments."

Notwithstanding the above stated advances in the forging field, scientists and engineers continue to search for new concepts and techniques which enhance the maufacturability of forged components and improve the quality of such components.

DISCLOSURE OF THE INVENTION

According to the present invention a single die set comprises a plurality of automatically sequenceable die elements including a first element for deforming a preform metal billet under conditions of low strength and high ductility to a preferred intermediate shape and a second element for deforming said intermediary piece at retained conditions of low strength and high ductility to a desired finished shape.

According to the method taught a metal billet of high strength, low ductility metal alloy is processed to a condition of low strength, high ductility within a set of sequenceable die elements, and is deformed under pressure within the set of sequenceable elements to a first configuration and without being removed from the die to a second configuration.

A primary feature of the present invention is the movable die. The movable die is formed of at least two sequenceable elements. In the embodiment illustrated a central disk and outer ring are employed. The dies are driven in sequence to form the billet to a first configuration and thence to a second configuration without withdrawing the press from the die package. A plurality of pressure pins extend downwardly from a spider plate to prevent displacement of the outer ring as the central disk is pressed into the billet being formed.

A principal advantage of the present invention is the enhanced ability to form components of complex geometry. Billet material is formed to a first configuration during an initial step to provide for improved distribution of material in a subsequent step. Intricate appendages, such as rotor blades of gas turbine engines, are formable to accurate dimension and contour at the periphery of a supporting structure. Forming the billet to an intermediate configuration with preferred material distribution, enables the effective subsequent redistribution of material in later steps to appendages of complex shape. Effective sequencing of the die package is enabled by initially restraining the dies to be later pressed into the billet material. The later sequenced dies form a portion of the mold in earlier steps wherein billet material is moved to preferred locations in the intermediate configuration.

The foregoing, and other features and advantages of the present invention, will become more apparent in the light of the following description and accompanying drawing.

DETAILED DESCRIPTION

Figure 1:
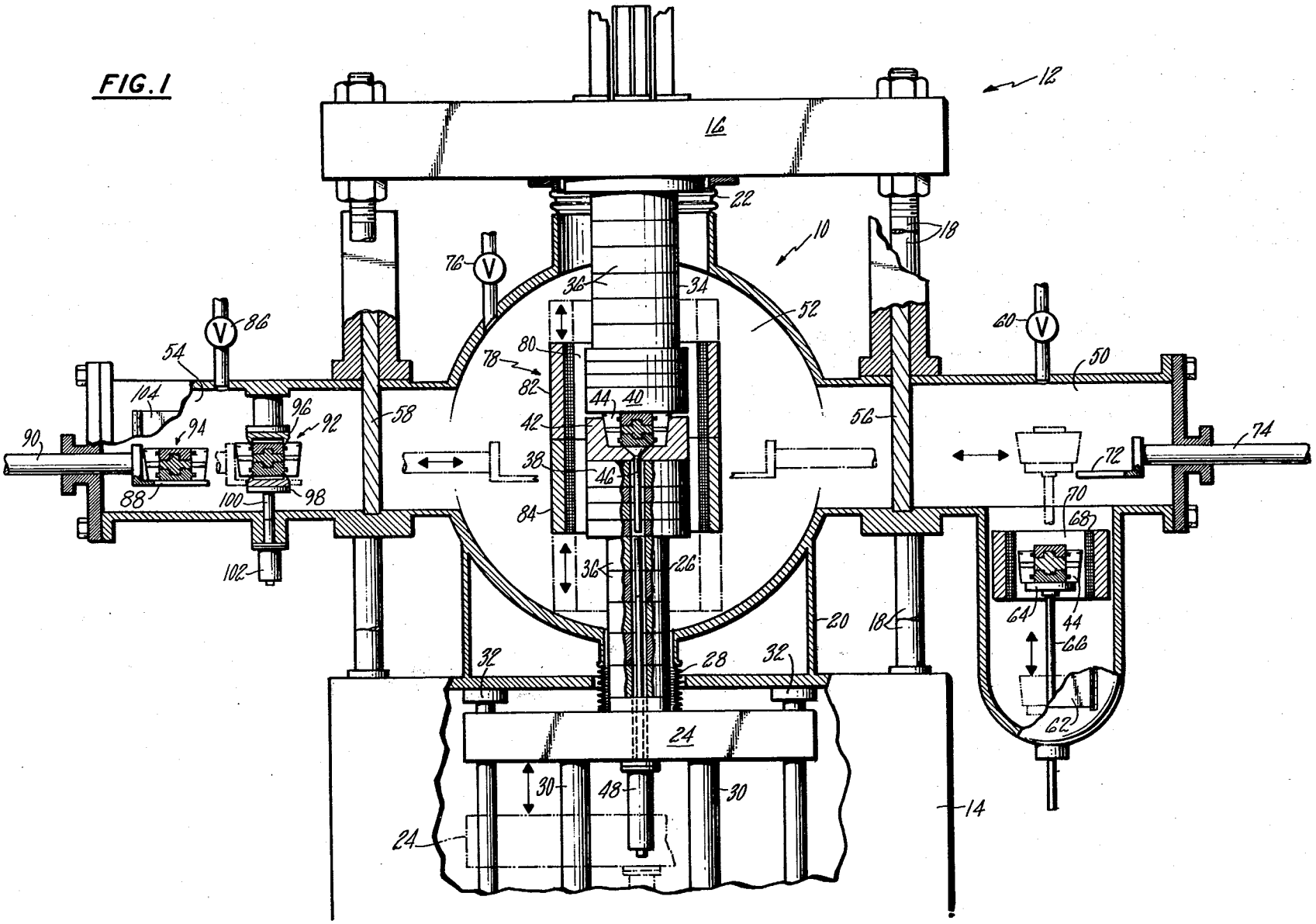
FIG. 1 is a schematic representation of forging apparatus in which the concepts of the present invention are employable.

The methods and apparatus of the present invention are known to have high utility in the forging field, and particularly in the forging of components having complex geometries by the techniques described in U.S. Pat. No. 3,519,503 to Moore et al entitled "Fabrication Method for the High Temperature Alloys." The Moore et al process is well suited to automated manufacture such as that illustrated in the FIG. 1 simplified representation of automated forging apparatus. Within the apparatus a high strength, low ductility material is processed to a temporary state of low strength, high ductility so as to enable the flow of billet material into die cavities of intricate contours or complex shape during the forging process. Subsequent to the forging operation, the finished workpiece is heat-treated to restore the material to its former conditions of high strength and low ductility.

The forging process is performed within a containment vessel 10 under a hydraulic press 12. The press has a bed 14 and a head 16 which are spaced apart by a plurality of tie rods 18. The containment vessel is supported by structure 20 extending upwardly from the press bed. The upper end of the containment vessel is joined to the press head at a bellows 22.

A ram plate 24 within the press bed 14 supports a lower die column 26 within the containment vessel 10. The ram plate is movable with respect to the containment vessel and is joined thereto by a bellows 28. A plurality of forging rams 30 position the plate and move the plate upwardly with great force during the forging process. The forging rams are movable by a hydraulic actuator not shown. A plurality of ram stops 32 extend upwardly from the ram plate to limit upward travel of the plate during the forging process. An upper die column 34 extends downwardly from the press head into the containment vessel.

Both the upper die column 34 and the lower die column 26 are made up of a plurality of flat plates 36. The top plate 38 of the lower die column and the bottom plate 40 of the upper die column are manufacture of a low thermal conductivity material, such as molybdenum. A bull ring 42 also of low thermal conductivity material, such as molybdenum, rests atop the plate 38 of the lower die. A die package 44 is positionable within the bull ring. The bottom plate of the upper die column rests atop the die package with a die opposing surface facing the movable elements of the die package. A breakout ram 46 extends upwardly through the lower die column and the bull ring from an actuator 48.

The containment vessel 10 is divided into three (3) isolatable chambers: a preheat chamber 50, a forging chamber 52, and a cool-down chamber 54. An entry door 56 separates the forging chamber from the preheat chamber and an exit door 58 separates the forging chamber from the cool-down chamber.

The preheat chamber 50 has a valve 60 through which the pressure and the atmosphere in the preheat chamber is controllable. A loading door 62 provides access to the preheat chamber for the placement of die packages 44 into the containment vessel. A preheater table 64 at the end of a preheater arm 66 supports each die package in the preheater section. A heating element 68 is provided at a preheating station 70 within the chamber. The preheater table and arm are adapted for vertical travel through the preheater chamber for raising each die package to and through the heating element. In a typical embodiment the preheater arm extends upwardly from a hydraulic actuator which is not shown in the drawing. Above the heating element a loading tray 72 at the end of a loading arm 74 is adapted for horizontal movement across the preheater chamber. With the preheater table in a raised position, the loading tray is capable of receiving the die package from the preheater table. With the preheater tray in a retracted position the loading tray and loading arm are capable of shuttling the die package into the forging chamber. Horizontal movement of the loading tray and loading arm in a typical embodiment is provided by a hydraulic actuator which is not shown in the drawing.

The forging chamber 52 has a valve 76 through which the pressure and the atmosphere in the forging chamber is controllable. A heating element 78 is provided at a forging station 80 within the chamber. The heating element is split into an upper heating element 82 and a lower heating element 84. The two heating elements are vertically separable to allow access to the bull ring 42 atop the lower die column 26. With the heating elements separated and the lower die column retracted with the ram plate 24, the breakout ram is capable of lifting the die package 44 from the extended loading tray 72 and lowering the die package into the bull ring for forging. In a like manner with the forging operation complete, the ram plate is retractable and the breakout ram is extendable to raise the die package out of the bull ring.

The cool-down chamber 54 has a valve 86 through which the pressure and the atmosphere in the cool-down chamber is controllable. An unloading tray 88 at the end of an unloading arm 90 is adapted for horizontal movement across the cool-down chamber. The unloading tray and arm are extendable into the forging chamber 52 for receiving a die package 44 from the breakout ram 46. The cool-down chamber has a die expansion station 92 and a cooldown station 94. The die expansion station has an upper expansion ring 96 and a lower expansion ring 98. An expander arm 100 extending upwardly from a hydraulic actuator 102 raises the lower expansion ring upwardly to lift a die package off of the unloading tray. The actuator further urges the rings together to cause the elements of the die package to break away from the forged workpiece. An unloading door 104 provides access to the cool-down chamber for the removal of die packages.

Figure 2:
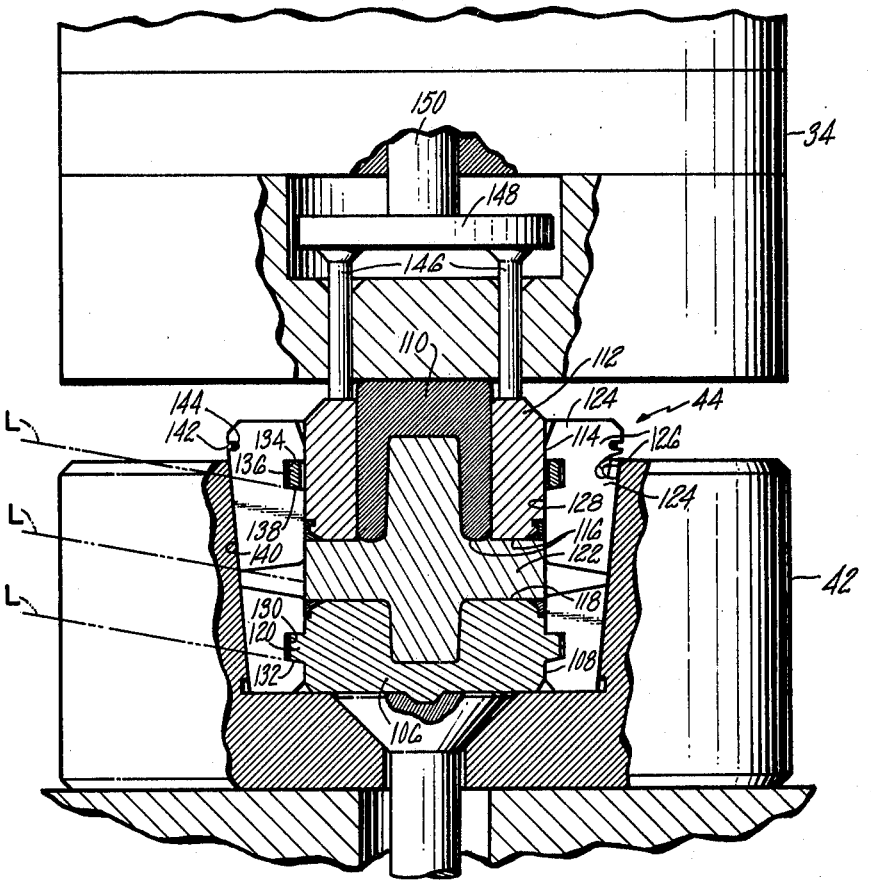
FIG. 2 is a cross section view through a portion of the FIG. 1 apparatus showing a billet containing die package in the press prior to commencement of the forging sequence.

A die package 44 constructed in accordance with the concepts of the present invention is illustrated by FIG. 2. The die package includes a stationary die 106 of generally cylindrical geometry having an outer surface 108 and at least two movable dies, such as the first movable die, or central disk 110 and the second movable die, or ring 112. The first and second movable dies are mounted on a common axis with the stationary die 106. The second movable die has a generally cylindrical geometry with an outer surface 114. The second movable die is contained within the first movable die. The movable dies have end surfaces 116 which in composite are contoured to the inverse geometry of one side of the component to be formed. The stationary die has an end surface 118 contoured to the inverse geometry of the other side of the component to be formed.

A circumferentially extending collar 120 is raised outwardly from the cylindrical outer surface of the stationary die. A billet of material 122 from which the workpiece is to be forged is contained between the stationary and movable dies. A plurality of arcuate die segments 124 are adjacently placed in cylindrical array about the stationary and movable dies, and form in conjunction therewith a cavity having the inverse geometry of the desired component including appendages where appropriate.

Each of the die segments 124 has a pair of circumferential side walls 126 which are contoured to form, in conjunction with the side walls of the adjacent segments, a plurality of circumferentially spaced cavities having the inverse geometry of the appendages to be formed. Each segment has an inner arcuate surface 128 including a channel 130 extending thereacross which interlocks with the collar 120 of the stationary die to prevent tilting of each segment with respect to the stationary die. The collar has at least one tapered side surface 132 which enables withdrawal of the die segments from the collar along a desired line of pull (L) from the appendages.

In a more detailed die package also illustrated in FIG. 2, the inner arcuate surface 128 of each segment 124 includes a second channel 134 in the region of the movable die 110. Each channel 134 interlocks with a ring 136 of closely dimensioned tolerance therewith to provide additional resistance to segment tilting. As is the case with the collar the ring has a tapered side surface 138 which enables withdrawal of the segments from the ring along the desired line of pull (L). The collar and ring concepts may be used independently or in combination.

Each die segment 124 further has an outer arcuate surface 140 having a groove 142 extending thereacross to form in composite with the grooves of the adjacent segments, an outer channel which extends fully around the cylindrical array. A wire 144 extends within the outer channel about the die segments to hold the elements of the die package in a unitized assembly.

Also illustrated in FIG. 2 is apparatus contained within the upper die column 34 for preventing displacement of the first die element by the workpiece as said second die element is pressed against the workpiece. The apparatus includes a plurality of pressure pads 146 extending downwardly from a spider plate 148 onto the first die element. A common rod, or ram 150 positions the spider plate. The ram is moved by a hydraulic actuator at the top of the press which is not shown.

Figure 3:
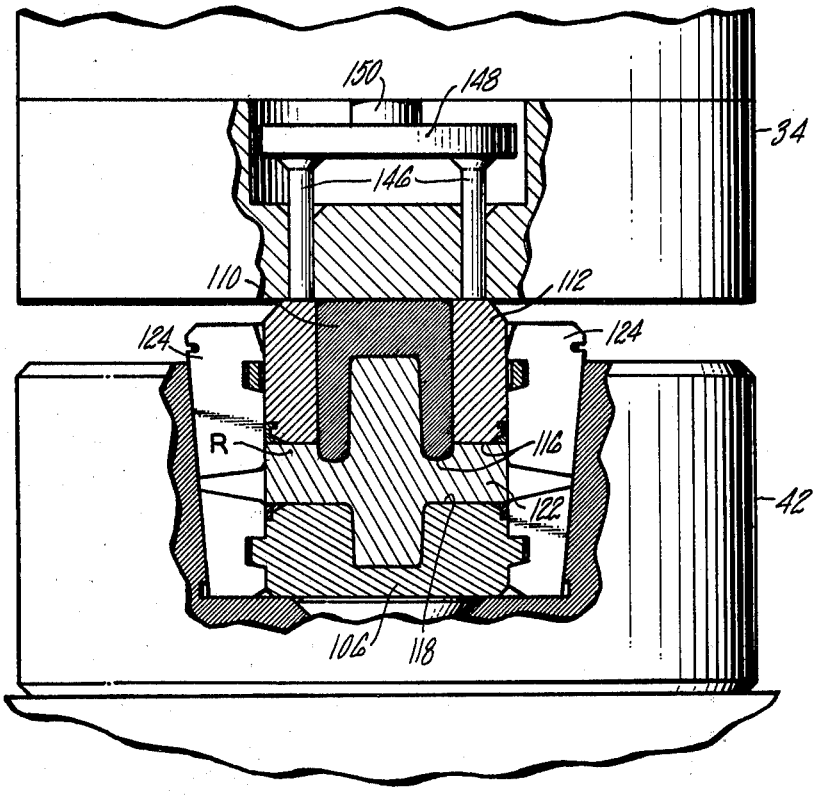
FIG. 3 is a cross section view corresponding to FIG. 2 wherein the billet has been forged to a first configuration by pressing the central disk into the billet.
Figure 4:
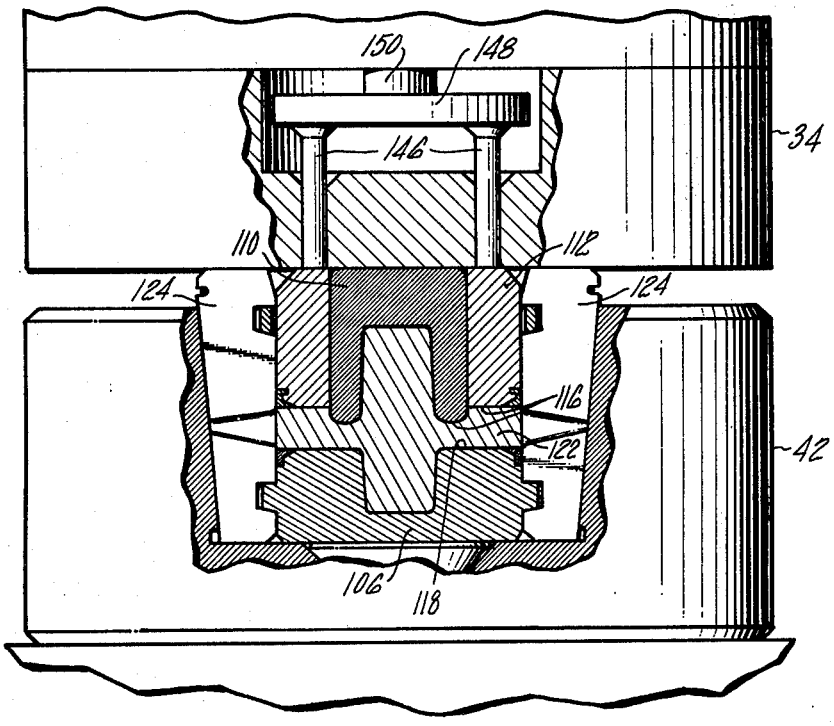
FIG. 4 is a cross section view corresponding to FIG. 2 wherein the billet has been forged to a second and final configuration by pressing the outer ring into the billet.

The forging method claimed herein is illustrated by the related FIGS. 2–4. In FIG. 2 the array of die segments 124 is first disposed about the stationary die 106. The wire 144 is placed in the groove 142 and tightened to hold the segments 124 in place. The billet 122 of material from which the workpiece is to be formed is placed upon the stationary die within the cylindrical array and the movable die containing the central element 110 and the ring 112 is placed upon the billet within the cylindrical array to complete the die package.

The die package is placed in a forging chamber such as that illustrated by FIG. 1 and raised in temperature to place the billet material in a temporary condition of low strength, high ductility. Pressure pads 146 are placed against the second movable die or ring 112.

As illustrated by FIG. 3, the first movable die or central die element 110 is pressed into the billet 122 to form a workpiece to an intermediate configuration. The pressure pads prevent displacement of the ring 112 by the flowing billet material. In the configuration the workpiece has billet material distributed to a preferred region for subsequent forging. For example, in the region R material is collected for subsequent pressing into the airfoil cavities between adjacent die segments.

In the FIG. 4 illustration, the pressure on the pads 146 has been relieved or overridden by the force of the rising ram plate 24. The second movable die or ring 112 and the first movable die 110 are pressed simultaneously into the billet. The pocket of material in the region R is forced fully to the ends of the appendage forming cavities between adjacent segments thus forming the workpiece to the second, or final configuration.

Although the invention has been shown and described with respect to detailed embodiments thereof, it should be understood by those skilled in the art that various changes and omissions in form and detail may be made therein without departing from the spirit and the scope of the invention.

What is claimed is:

1. A die package for forming a central disk structure and a plurality of integrally formed appendages extending therefrom, said die package comprising:

a stationary die of generally cylindrical geometry having an outer surface;

a movable die of generally cylindrical geometry having an outer surface;

a further movable die of generally cylindrical geometry contained within said movable die and slideable with respect thereto independently of the first movable die during the forming operation, both said movable dies being axially aligned with said stationary die and spaced apart therefrom; and a cylindrical array of circumferentially adjacent die segments, each segment having a pair of circumferential side walls in abutting relationship with the side walls of the adjacent segments and being contoured to form therewith a plurality of circumferentially spaced cavities of the inverse geometry of the appendages to be formed, and an inner arcuate surface contacting the outer surfaces of said stationary and movable dies.

2. The invention according to claim 1 which further includes means for interlocking said die segments of the cylindrical array to prevent tilting thereof in the die package.

3. The die package according to claim 2 wherein the inner arcuate surface of each of said die segments has a channel thereacross and wherein said means for interlocking the die segments comprises a circumferentially extending collar which is raised outwardly from the cylindrical outer surface of the stationary die and which interlockingly engages the channel of each die segment to prevent tilting of the segments.

4. The die package according to claim 3 wherein the inner arcuate surface of each of said die segments has a second channel thereacross and wherein said means for interlocking the die segment further includes a ring which interlockingly engages the second channel of each die segment.

5. The die package according to claim 2 wherein the inner arcuate surface of each of said die segments has a channel thereacross and wherein said means for interlocking the die segments comprises a ring which interlockingly engages the channel of each die segment to prevent tilting of the segments.

6. The die package according to claim 1, 2, 3, 4 or 5 wherein each of said arcuate die segments has an outer arcuate surface having a groove extending thereacross to form an outer channel about the die segments and wherein the die package further has a wire extending circumferentially about the array of segments in the grooves of the outer surfaces to hold the elements of the package in a unitized assembly.

* * * * *